US008016360B2

(12) United States Patent
Machael et al.

(10) Patent No.: US 8,016,360 B2
(45) Date of Patent: Sep. 13, 2011

(54) ADJUSTABLE ARM REST FOR CHAIR

(75) Inventors: Jay R. Machael, Muscatine, IA (US); Marcus C. Koepke, Indianapolis, IN (US); Brian R. Trego, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 12/183,161

(22) Filed: Jul. 31, 2008

(65) Prior Publication Data

US 2009/0033139 A1 Feb. 5, 2009

Related U.S. Application Data

(60) Provisional application No. 60/953,213, filed on Aug. 1, 2007.

(51) Int. Cl.
*A47C 7/54* (2006.01)
*B60N 2/46* (2006.01)

(52) U.S. Cl. ..... 297/411.37; 297/411.38

(58) Field of Classification Search ..... 297/411.35, 297/411.37, 151, 158.2, 160–162, 115, 411.38
See application file for complete search history.

(56) References Cited

U.S. PATENT DOCUMENTS 939,623 A * 11/1909 Payne et al. ..... 297/161
3,353,866 A * 11/1967 Chapman et al. ..... 297/162
4,674,790 A * 6/1987 Johnson ..... 296/153
4,877,287 A * 10/1989 Escaravage ..... 297/411.36
5,484,187 A * 1/1996 Doerner et al. ..... 297/411.3
6,017,091 A 1/2000 Cao
6,059,366 A 5/2000 Hu
6,142,559 A * 11/2000 Sorel et al. ..... 297/135
6,213,556 B1 4/2001 Chen
6,572,195 B1 6/2003 Lee
6,592,085 B2 7/2003 Iwata et al.
6,799,803 B1 * 10/2004 Lee et al. ..... 297/411.35
6,802,566 B2 10/2004 Prince et al.
6,969,116 B2 11/2005 Machael et al.

(Continued)

FOREIGN PATENT DOCUMENTS

DE 29809099 U1 7/1999

(Continued)

OTHER PUBLICATIONS

International Search Report and Written Opinion for PCT/US2008/071684, mailed Jun. 11, 2008.

*Primary Examiner* — David Dunn
*Assistant Examiner* — Tania Abraham
(74) *Attorney, Agent, or Firm* — Faegre & Benson LLP

(57) ABSTRACT

An adjustable armrest assembly for a chair includes a mounting member connected to the chair. The mounting member has an upper base. A first horizontal slide element is slidably mounted to the upper base and is adjustably slidable in a first direction with respect to the upper base. The first slide element is restrained after adjustment with respect to the upper base by frictional engagement between the upper base and the first slide element. A second horizontal slide element for slidably mounting to the first slide element is slidable in an arcuate path crossing the first direction. The second slide element is restrained after adjustment with respect to the first slide element by frictional engagement between the second slide element and the first slide element.

23 Claims, 9 Drawing Sheets

U.S. PATENT DOCUMENTS 6,974,189 B2 12/2005 Machael et al.
6,994,400 B2 2/2006 Koepke et al.
7,066,538 B2 6/2006 Machael et al.
7,066,546 B2 * 6/2006 Trego et al. ..... 297/411.37
7,234,775 B2 * 6/2007 Serber ..... 297/301.1
7,249,802 B2 * 7/2007 Schmitz et al. ..... 297/452.31
2005/0146192 A1 7/2005 Trego et al.
2005/0146195 A1 7/2005 Machael et al.

FOREIGN PATENT DOCUMENTS

EP 0958765 B1 7/2003

* cited by examiner

FIG. 4
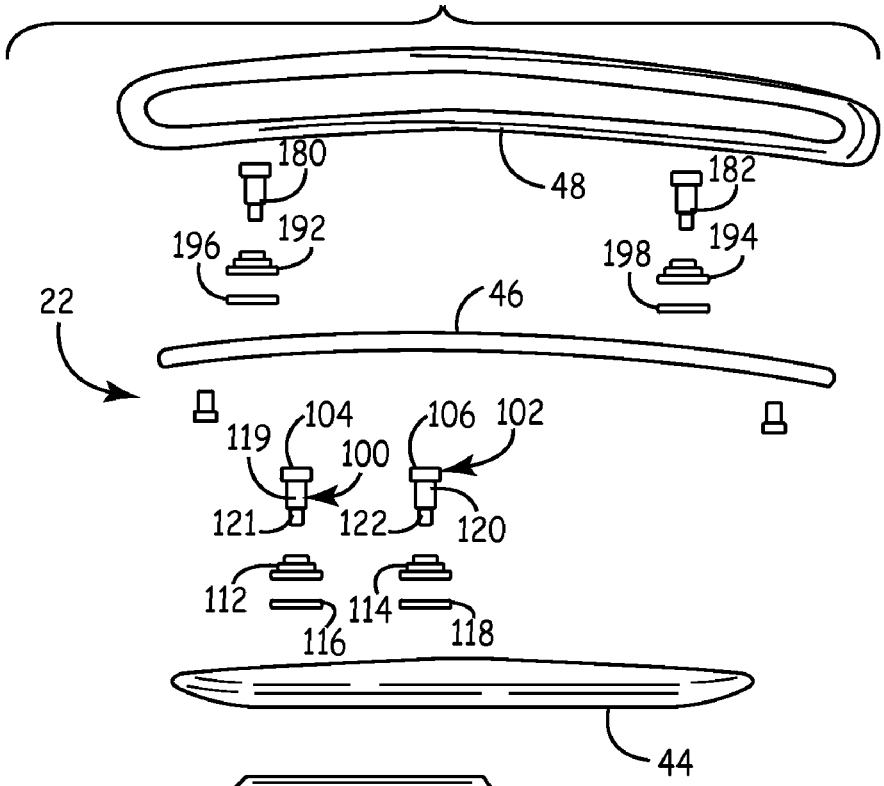
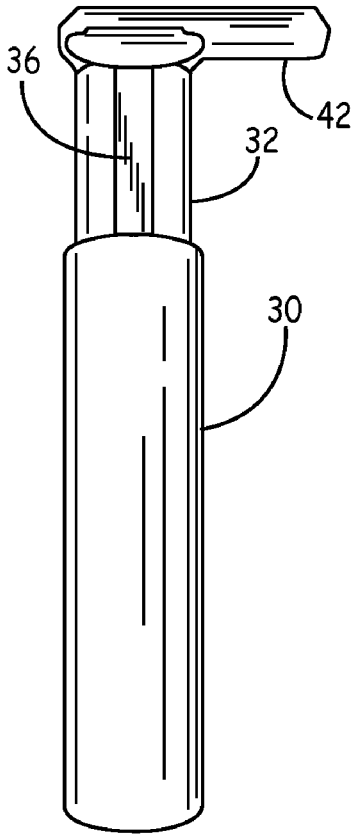
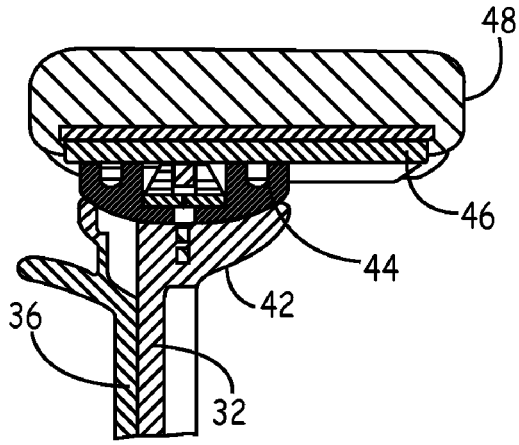
FIG. 5

ADJUSTABLE ARM REST FOR CHAIR

CROSS-REFERENCE TO RELATED APPLICATIONS

This application claims the benefit of Provisional Application Ser. No. 60/953,213, filed Aug. 1, 2007, which is hereby incorporated by reference in its entirety.

FIELD OF THE INVENTION

The present invention relates to an adjustable armrest for a chair. More particularly, the present invention relates to an adjustable armrest for an office chair, the armrest being capable of moving in a first direction and rotating in a path that crosses the first direction.

BACKGROUND

Adjustable armrests now appear in many office chairs. Some adjust laterally, that is, away from or in toward a chair user. Others move longitudinally, forwardly and backwardly, relative to the chair and the user. Still others swivel in a horizontal plane or tilt about a horizontal axis. In other cases, chairs have armrests that put two or more of the above mentioned movements together.

Examples of adjustable armrests are shown in U.S. Pat. Nos. 7,066,546, 6,802,566, 6,592,085, 6,572,195, 6,213,556, 6,059,366, and 6,017,091.

SUMMARY

In one aspect of the present invention, an adjustable armrest assembly for a chair includes a mounting member connected to the chair. The mounting member has an upper base. A first horizontal slide element is slidably mounted to the upper base and is adjustably slidable in a first direction with respect to the upper base. The first slide element is restrained after adjustment with respect to the upper base by frictional engagement between the upper base and the first slide element. A second horizontal slide element for slidably mounting to the first slide element is slidable in an arcuate path crossing the first direction. The second slide element is restrained after adjustment with respect to the first slide element by frictional engagement between the second slide element and the first slide element.

In another aspect of the present invention, an adjustable armrest assembly for a chair includes a mounting member connected to the chair. The mounting member has an upper base. A first horizontal slide element is slidably mounted to the upper base and is slidable in a first direction with respect to the upper base. The first slide element maintains after adjustment a substantially fixed position with respect to the upper base by frictional engagement. A second slide element is slidably mounted to the first slide element in an arcuate path that crosses the first direction.

In a further aspect of the present invention, an adjustable armrest assembly for a chair includes a mounting member connected to the chair. The mounting member has an upper base. The upper base includes first and second guide rails extending in a first direction, and first and second spaced apart fastener receiving openings. A first elongated slide structure is mounted to the upper base and extends in the first direction. The first slide structure includes a first elongated slot aligning with the first and second fastener receiving openings of the upper base and extending to a distance greater than the distance between the first and the second fastener receiving openings of the upper base. A lower surface engages the first and the second guide rails of the upper base. An upper surface has first and second guide rails that extend in a first arcuate path that crosses the first direction, and third and fourth spaced apart fastener receiving openings. A second elongated slide structure is mounted to the first slide structure and extends in the first direction. The second slide structure includes second and third elongated slots. The second slot is aligned with the first fastener receiving opening of the upper surface of the first slide structure, and the third slot is aligned with the second fastener receiving opening of the upper surface of the first slide structure. The second and third slots extend in a second arcuate path that crosses the first direction, and a lower surface has first and second elongated recesses for engaging the first and second guide rails of the upper surface of the first slide structure.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with 35 U.S.C. §112 (first paragraph), but the invention itself is defined by the attached claims.

BRIEF DESCRIPTION OF THE DRAWINGS

FIG. 4 is an exploded side elevation view of the armrest shown in FIGS. 2 and 3.

FIG. 5 is a partial, sectional front elevation view of the armrest shown in FIGS. 2-4.

Figure 1:
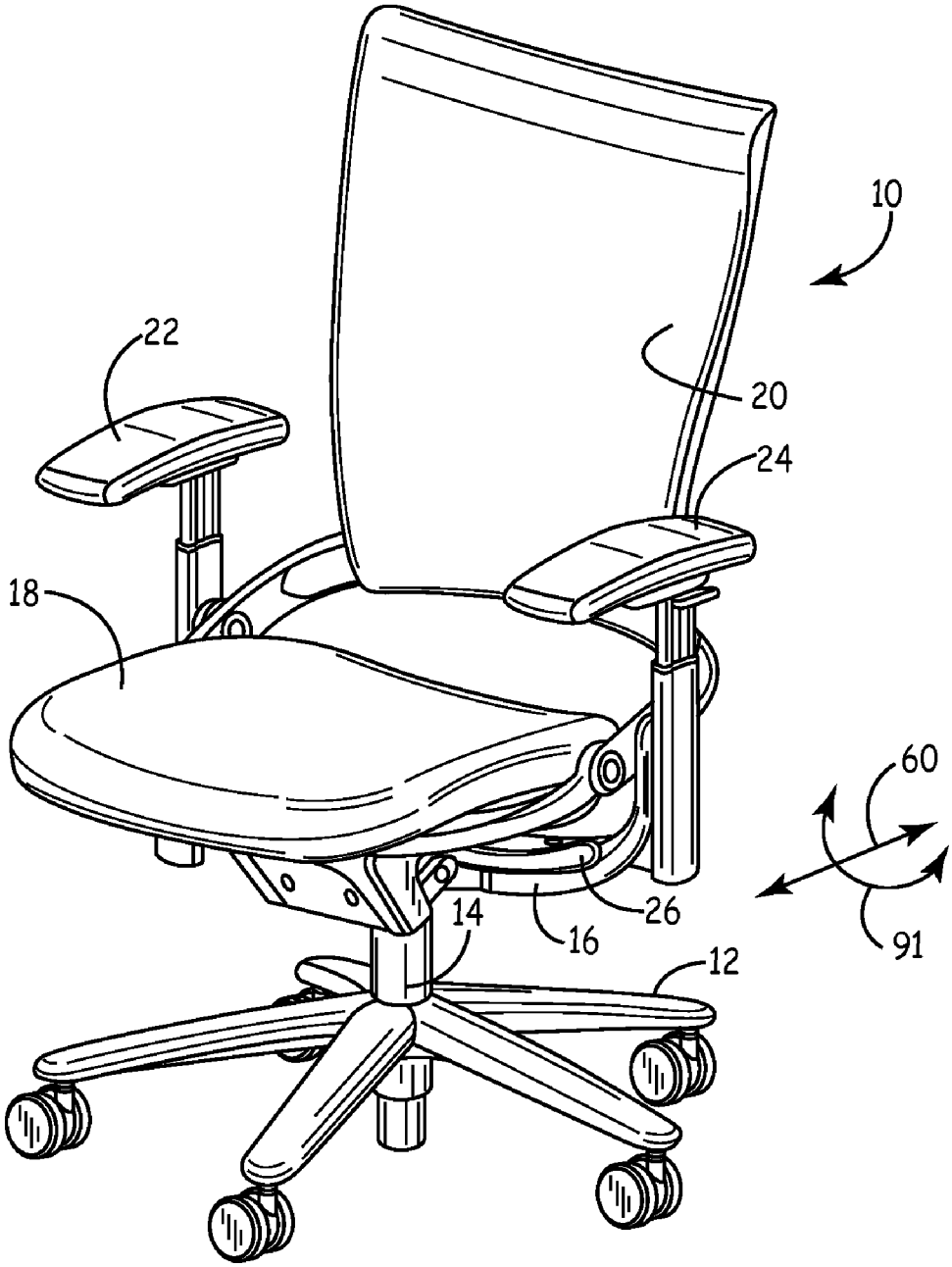
FIG. 1 is an isometric view of an office chair with adjustable armrests.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

While the present invention is open to various modifications and alternative constructions, the preferred embodiment shown in the various figures of the drawing will be described herein in detail. It is understood, however, that there is no intention to limit the invention to the particular embodiment, form or example which is disclosed here. On the contrary, the intention is to cover all modifications, equivalent structures and methods, and alternative constructions falling within the spirit and scope of the invention as expressed in the appended claims, pursuant to 35 U.S.C. §112 (second paragraph).

Referring now to FIG. 1, there is shown an office chair 10 having adjustable armrests. The chair includes a base 12, a pedestal 14, a frame assembly 16, a seat assembly 18, a back assembly 20, a pair of adjustable armrests 22, 24 and control levers, such as a control lever 26.

The simplicity of the adjustable armrests may be appreciated by referring to FIGS. 2, 3, 4 and 5. The armrest 22 includes a support tube 30 connected to the frame assembly 16, a mounting member in the form of a vertical adjustment slide 32, a notched plate 34, an operating rod 36, a lock block 38 and a spring 40. The vertical adjustment slide acts as a mounting member and is formed with an upper base 42. Slidably mounted to the upper base 42 is a first or lower slide element 44. Slidably mounted to the lower slide element 44 is a second or upper slide element 46 and attached to the upper slide element 46 is an armrest cover 48.

Reference is made to patents and patent publications assigned to the same assignee as the present application and entitled Vertically Adjustable Chair Armrest, U.S. Pat. No. 6,974,189; Chair with Backward and Forward Passive Tilt Capabilities, U.S. Pat. No. 6,969,116; Chair Back, U.S. Patent Application Publication 20050146195; Chair with Adjustable Seat Depth, U.S. Pat. No. 6,994,400; and Chair with Tilt Lock Mechanism, U.S. Pat. No. 7,066,538. These patents and publications disclose other features of the chair. All applications just mentioned are incorporated herein by reference. It is to be appreciated that a chair armrest may be fixed vertically and only adjustable horizontally, or may be fixed horizontally and only adjustable vertically, or the horizontal adjustment assembly disclosed here may be used with a vertical adjustment assembly different from that disclosed in U.S. Pat. No. 6,974,189.

Figure 6:
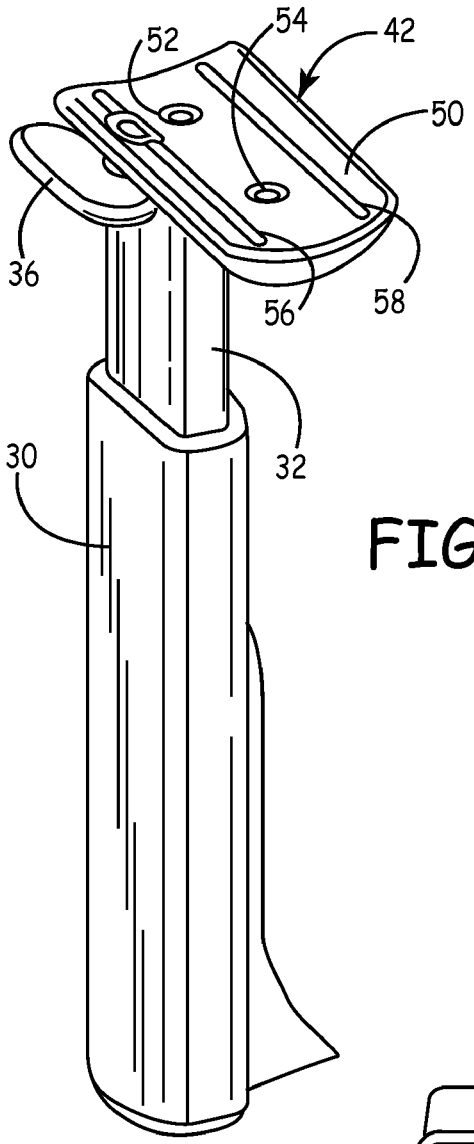
FIG. 6 is an isometric view of a mounting member with an upper base telescopically extending from a support.
Figure 7:
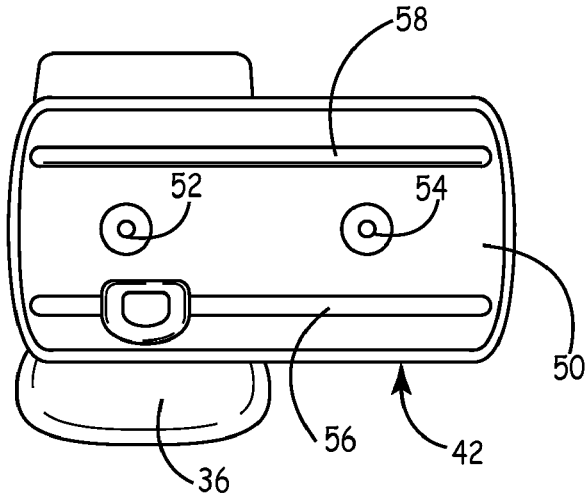
FIG. 7 is a top plan view of the upper base.

The upper base 42 has an arcuate upper surface 50 (FIGS. 5, 6 and 7) and two fastener receiving openings 52, 54. In alternative embodiments, upper surface 50 is planar or substantially planar. Threaded inserts, not shown, may be molded into the base. Two elongated projections or guide rails 56, 58 are also formed in the upper surface 50, the elongated projections being disposed parallel to a first direction that extends forwardly and rearwardly or longitudinally as symbolized by a double headed arrow 60, FIG. 1.

Figure 9:
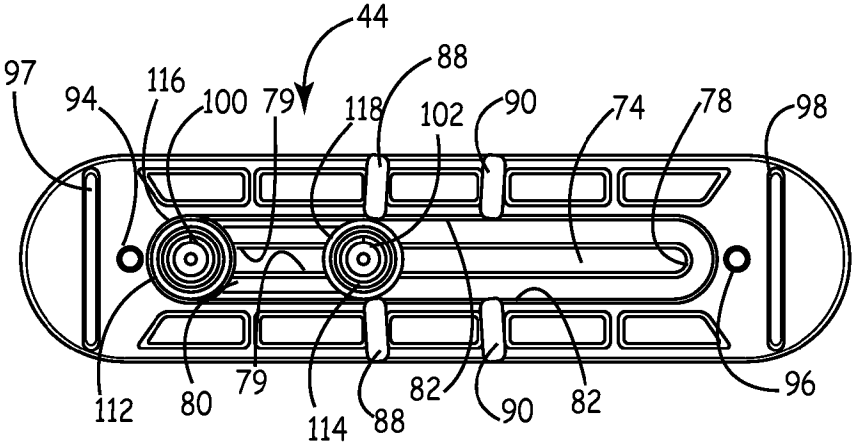
FIG. 9 is a top plan view of the first slide element shown in FIG. 8.
Figure 10:
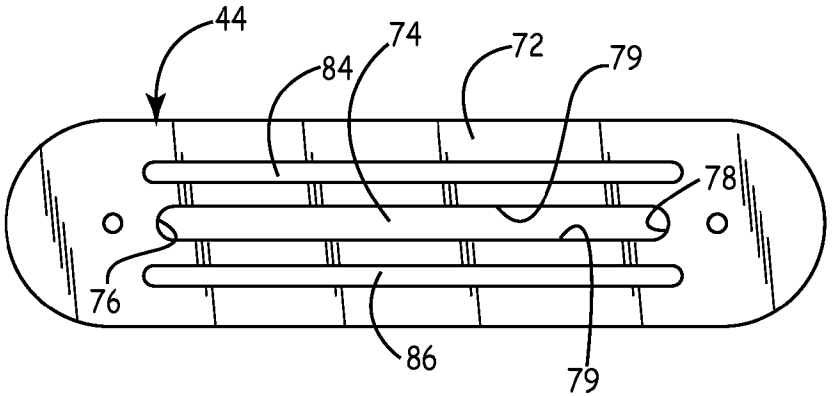
FIG. 10 is a bottom plan view of the first slide element.
Figure 8:
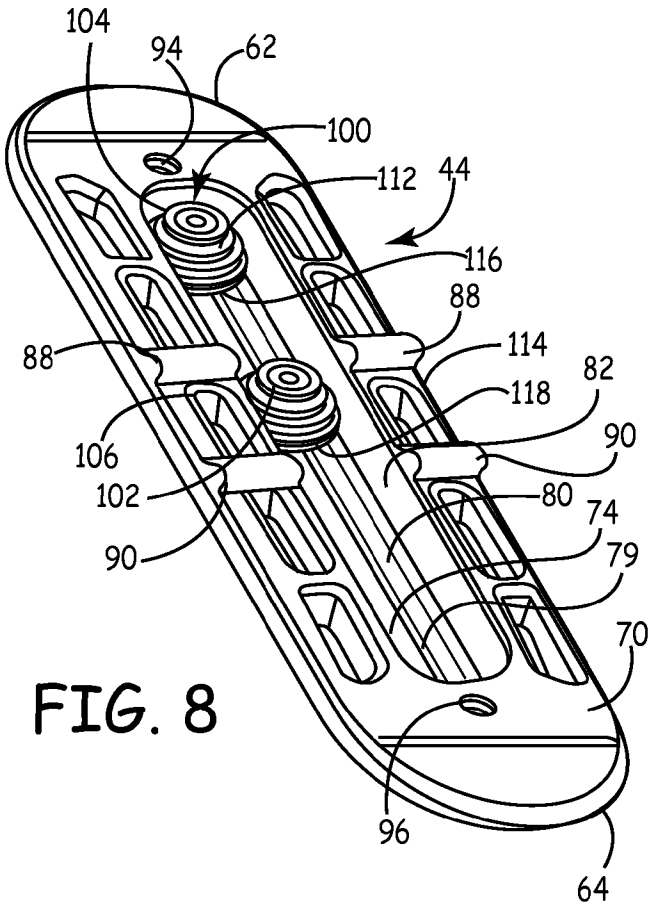
FIG. 8 is an isometric view of a first slide element of the armrest shown in FIGS. 2-7.

Referring now to FIGS. 8, 9 and 10, the lower slide element 44 is an elongated molded element having rounded end portions 62, 64, an upper surface 70 and a lower surface 72. An elongated mounting slot 74 extending in the longitudinal direction has two end portions 76, 78. Bordering the slot opening is a slot lower wall 79, a shoulder 80 and a slot upper wall 82. The lower surface 72 is arcuate in shape for generally nesting onto the upper surface 50 of the base 42. In alternative embodiments, lower surface 72 is planar or substantially planar. The lower surface 72 of the lower slide element is generally textured but also includes two parallel smooth runways 84, 86 for moving over the projections 56, 58 of the upper base 42. The upper surface 70 includes two curved projections or guide rails 88, 90 directed in an arcuate path which crosses the first direction. The arcuate path is symbolized by a double headed arrow 91 (FIG. 1). While the guide rails 88, 90 are shown proximate the center of the lower slide element 44 along its longitudinal axis, the guide rails 88, 90 may alternatively be located more proximate the ends of the lower slide element 44 along its longitudinal axis. The lower slide element 44 also includes two fastener receiving openings 94, 96 to receive fasteners attaching the upper slide element 46. Two projecting spacers 97, 98 are formed in the upper surface 70, and these engage the upper slide element 46 and compensate for manufacturing tolerances to help provide a consistent sliding force on the upper slide element. The length of the slot 74 helps define the longitudinal adjustment travel of the lower slide element relative to the upper base 42.

A pair of fasteners 100, 102 (FIGS. 2, 4, 8, 9, 10 and 11) are provided, each having a head 104, 106 and a stem 108, 110. Assembled around the stems are springs 112, 114 and placed beneath the springs are a pair of washers 116, 118. The fasteners are located so that the stems 108, 110 extend through the slot 74 of the lower slide element 44 and are received by and engaged with the fastener receiving opening 52, 54 of the upper base 42. The washers slide along the shoulder 80 and support the springs between them and the heads of the fasteners. Each of the fastener stems includes a shoulder portion 119, 120, (FIG. 4) and a thread portion 121, 122. The shoulder portions engage the lower slot wall 79 for guiding the sliding action of the lower slide element 44. Each washer 116, 118 includes a side rim which engages the upper slot wall 82, and also acts to guide the sliding action of the lower slide element 44.

Figure 11:
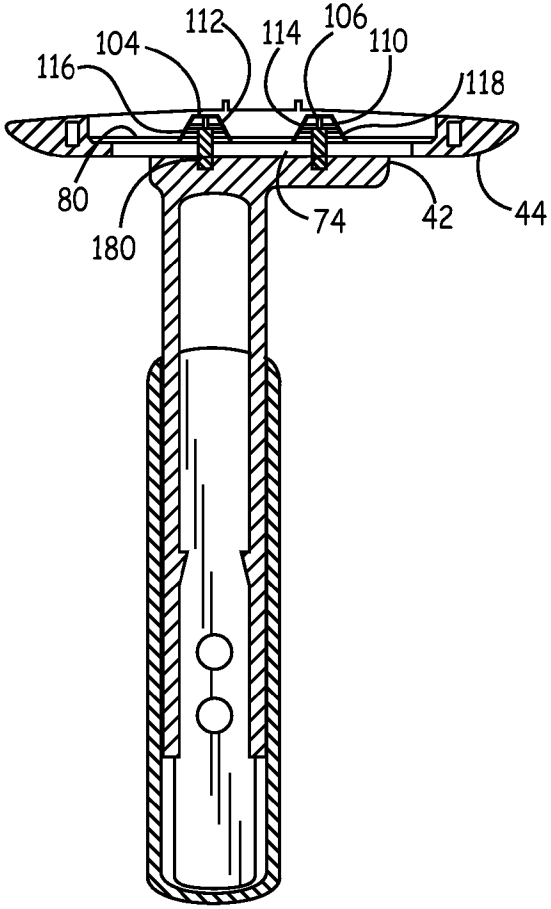
FIG. 11 is a sectional side elevation view of the first slide element mounted to the upper base.

The springs 112, 114 provide a biasing force against the washers 116, 118 which in turn bear against the shoulder 80, FIG. 11 of the slot. This arrangement ensures that the lower slide element 44 is pressed against the upper base 42 with a consistent force to compensate for manufacturing tolerances and provides the force to generate sufficient friction between the lower slide element 44 and the upper base 42 to restrain the location of the lower slide element once a chair user has adjusted the position of the lower slide element. Thus, flexibility is built into the manufacturing process of parts for the chair.

Figure 12:
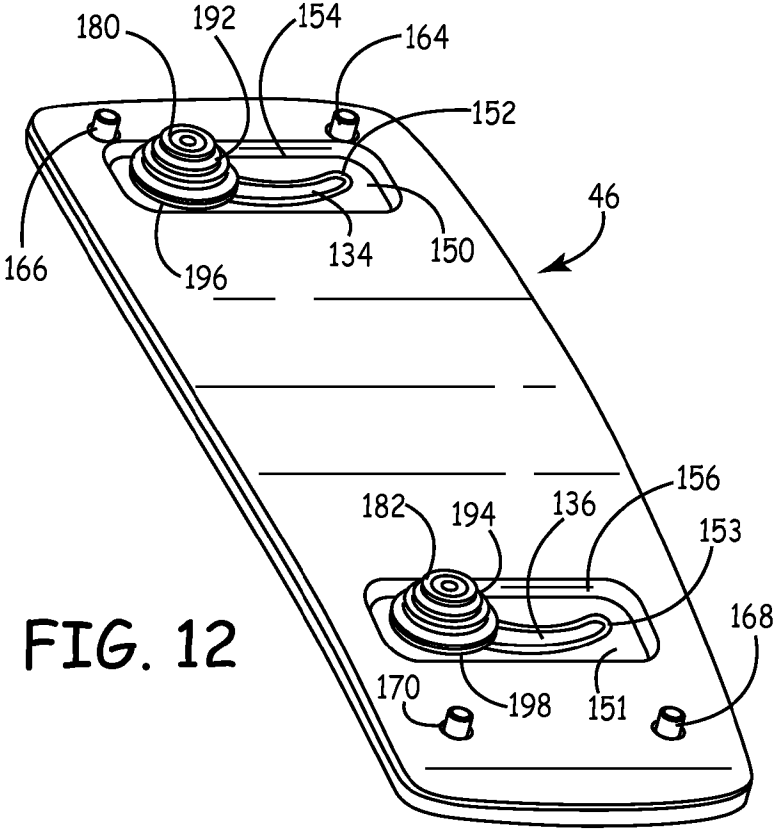
FIG. 12 is an isometric view of a second slide element.
Figure 16:
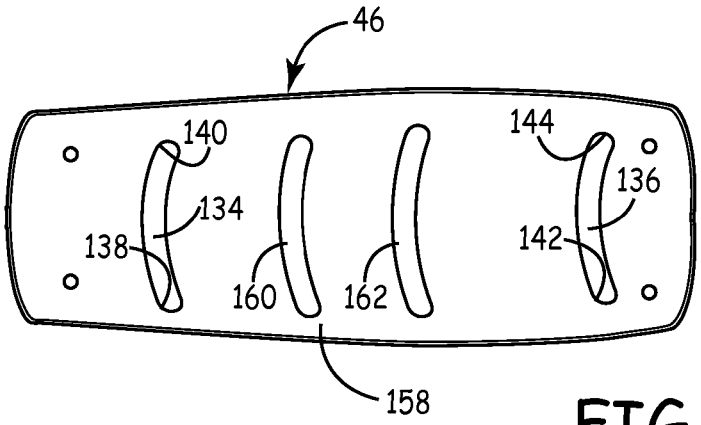
FIG. 16 is a bottom plan view of the second slide element.

The upper slide element 46 (FIGS. 12 and 16) is in the shape of a longitudinally arcuate panel with curved end portions 130, 132. The upper slide element 46 may alternatively be in the shape of a substantially planar longitudinal panel. The upper slide element 46 includes two arcuate lateral slots 134, 136 (extending along the arcuate path) each having closed ends 138, 140 and 142, 144. As used herein, "arcuate" is defined as any curved shape having either a constant or changing radius of curvature along its contour. The upper slide element 46 includes shoulders 150, 151 around the slots, lower slot walls 152, 153 and upper slot walls 154, 156. In a lower surface 158 of the upper slide element, a pair of arcuate recesses 160, 162 are formed to receive and engage the guide rails 88, 90 of the lower slide element. While the arcuate recesses 160, 162 are shown near the center of the upper slide element 46 along its longitudinal axis, the arcuate recesses 160, 162 may alternatively be located more proximate the ends of the upper slide element 46 along its longitudinal axis. Fastener openings 164, 166, 168, 170 are formed in the end portions and are used to receive fasteners to fasten the upper slide element to the armrest cover 48.

Another pair of fasteners 180, 182, (FIGS. 2, 12, and 16) are provided, each having a head 184, 186, (FIG. 2) and a stem 188, 190. Assembled around the stems are springs 192, 194 and placed beneath the springs are a pair of washers 196, 198. The fasteners are placed so that the stems extend through the slots 134, 136 of the upper slide element 46 and are received by and engaged with the fastener receiving opening 94, 96 of the lower slide element 44. The washers ride on the shoulders 150, 152 and support the springs between them and the heads of the fasteners. Each washer includes a peripheral rim 154, 156. The arcuate recesses 160, 162 guide sliding movement of the upper slide element 48 when the recesses engage the guide rails 88, 90 of the lower slide element 44.

The springs 192, 194 provide a biasing force against the washers which in turn bear against the shoulders 150, 152, and compensate for manufacturing tolerances. This arrangement also ensures that the upper slide element is pressed against the lower slide element with sufficient force to provide a needed friction force to restrain the location of the upper slide element once a chair user has adjusted the position of the upper slide element.

Figure 13:
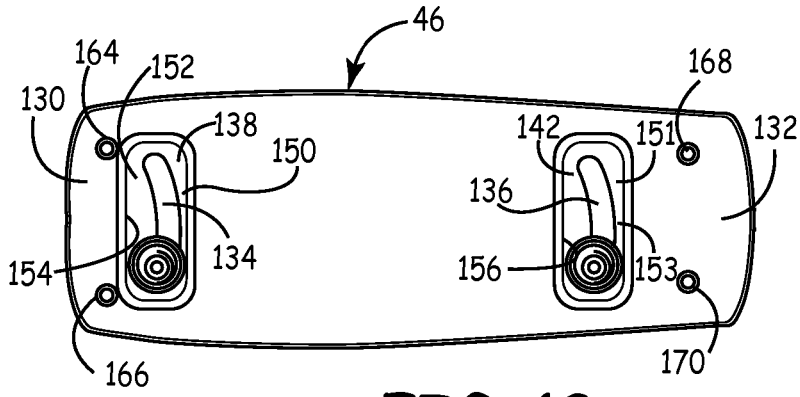
FIG. 13 is a top plan view of the second slide element.
Figure 14:
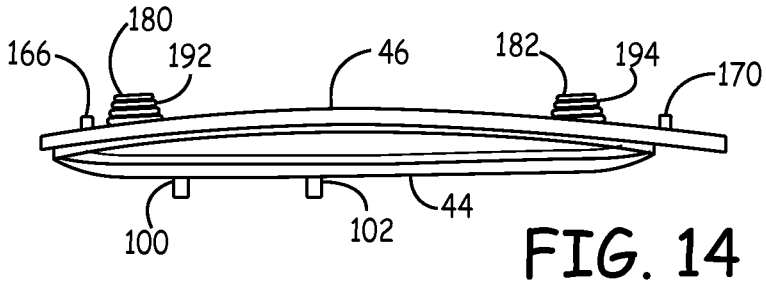
FIG. 14 is a side elevation view of the second slide element.
Figure 15:
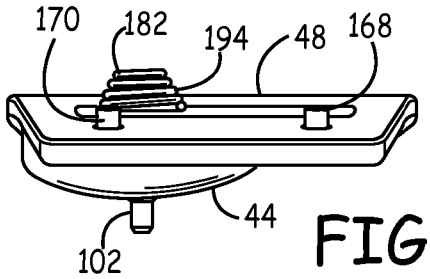
FIG. 15 is a front elevation view of the second slide element.

A set of four fasteners 200, 202, 204, 206, (FIGS. 2 and 3) are provided to be received by the fastener openings 164, 166, 168, 170, FIG. 13, of the upper slide element and engage the cover 48.

The mounting member and upper base, the lower slide element and the upper slide member may be formed of a suitable synthetic resin, such as nylon.

Figure 2:
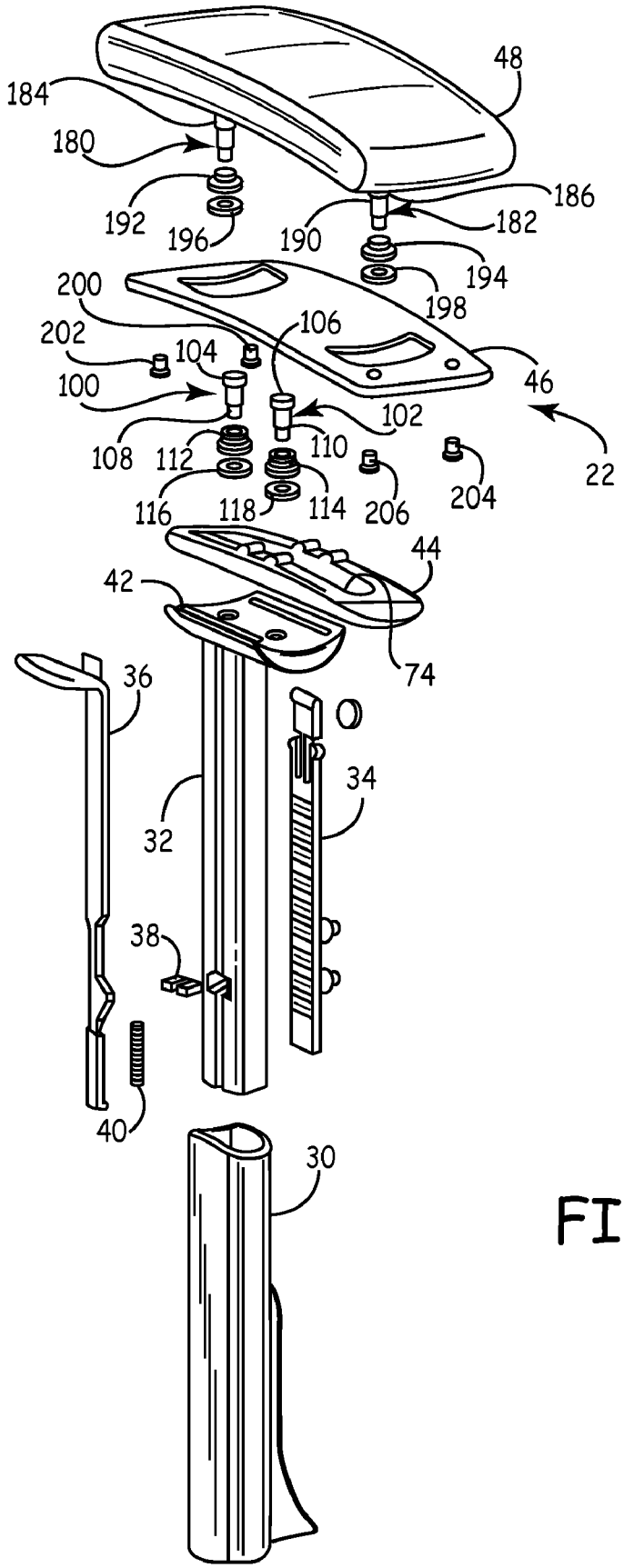
FIG. 2 is an exploded isometric view of one of the adjustable armrests.
Figure 3:
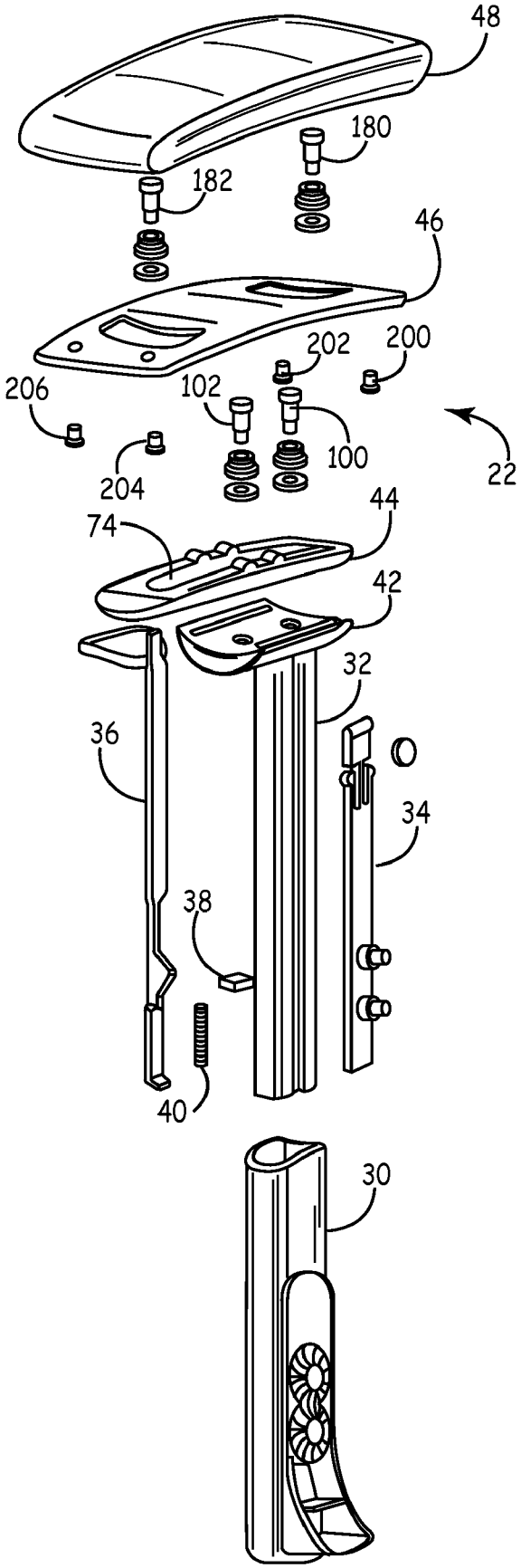
FIG. 3 is another exploded isometric view of the adjustable armrest rotated about 90 degrees from the view shown in FIG. 2.

The adjustable armrest is very easy to assemble and allows assembly to be quickly accomplished. The lower slide element 44 is connected to the upper base 42 of the vertical slide 32 using the two fasteners 100, 102. The arcuate recesses 160, 162 of the upper slide element are aligned with the guide rails 88, 90 of the lower slide element and the fasteners 180, 182 fit through the slots 134, 136 and are received in the openings 94, 96. The upper slide element 46 is connected to the armrest cover 48 by using the fasteners 200, 202, 204, 206, (FIGS. 2 and 3).

In operation, the lower slide element 44 is able to slide longitudinally (first direction) relative to the upper base 42 along the elongated slot 74. In a similar manner, the upper slide element 46 rotates in along the arcuate path relative to the lower slide element 44 within the length of the arcuate slots 134 and 136. The rotation may be about a fixed point that is aft of the arm rest such that arm rest motion tracks with rotation of the forearm and hand about the elbow or shoulder of the user.

Figures 17A, 17B, 17C:
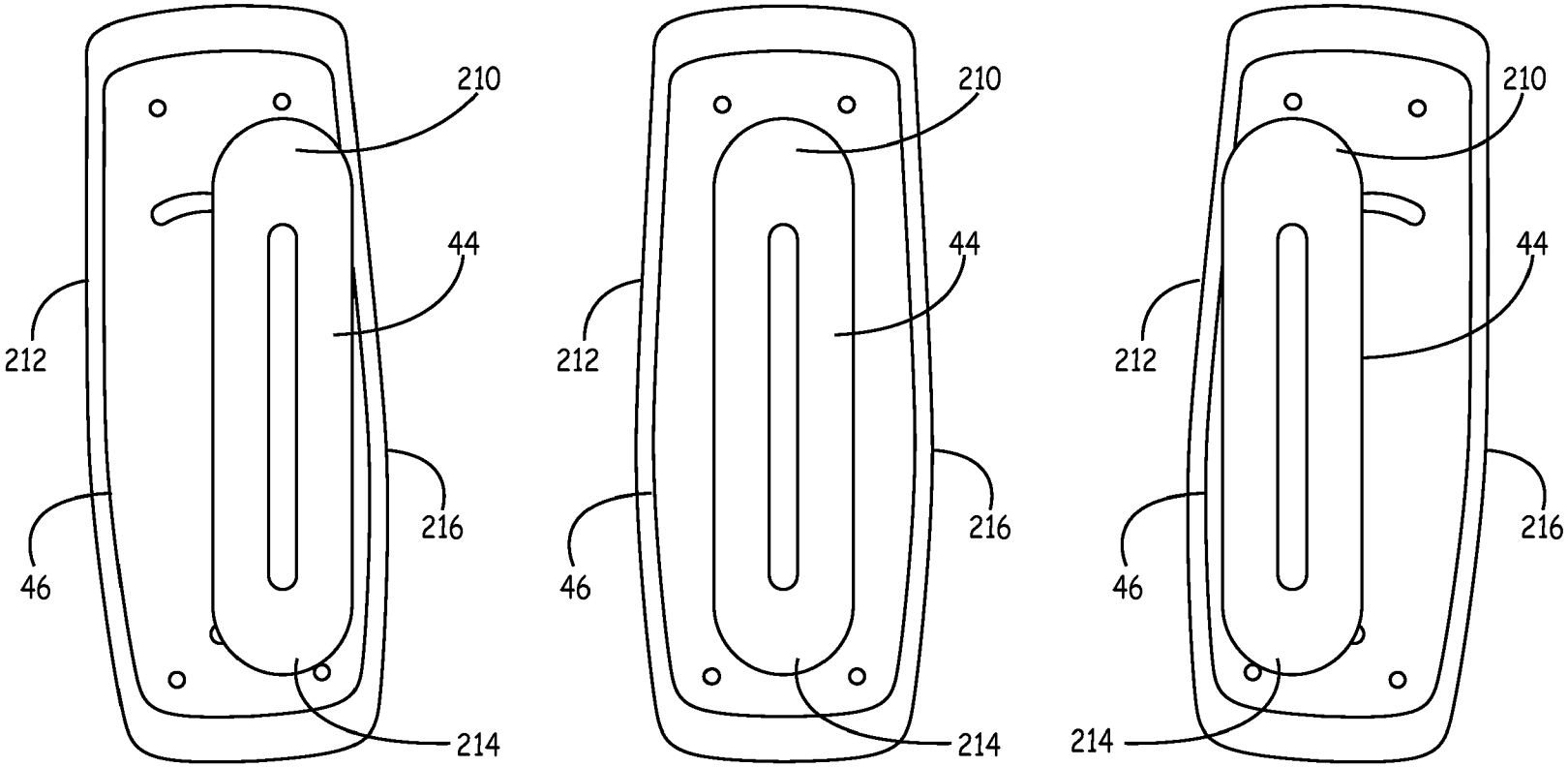
FIGS. 17A-17C are bottom views of the armrest rotation.

FIGS. 17A-C show the armrest in three different rotational positions. In FIG. 17A, the armrest 22 is shown at one terminal position as lower slide moves in an arcuate path relative to upper slide element 46. In this configuration, first end 210 of the lower slide element 44 is located nearer to a first edge 212 of upper slide element than is second end 214. In FIG. 17B, the lower slide element 44 is shown having moved through an arcuate path to a mid position between first edge 212 and second edge 216. In FIG. 17C, the lower slide element 44 is shown having moved through an arcuate path to a second terminal position so that first end 210 of lower slide element 44 is closer to second edge 216 than is second end 214.

It can now be appreciated that within the parameters of this movement, the armrests of the office chair may be adjusted longitudinally and rotationally to any position within the limits of movement. Moreover, this is done with a simply constructed, relatively inexpensive structure which structure is reliable and robust.

In summary, the present invention relates to an adjustable armrest for a chair comprising a mounting member connected to the chair, the member having an upper base, first and second slide elements mounted to the base, the first slide element being movable in a fore and aft direction while the second slide element causes rotation of the arm rest about a point such that the rotational motion of the arm rest roughly matches rotation of an arm around an elbow or shoulder. Each slide element has a slot and including fasteners positioned in the slots.

There are a number of advantages, features and objects achieved with the present invention. For example, one advantage is that the present invention provides for an adjustable chair armrest which is movable in fore and aft directions and is rotatable about a point thereby providing a wide range of adjustability. Another advantage of the present invention are that the adjustable armrest disclosed here is that motion of the arm tracks with rotation of the forearm and hand about the elbow or shoulder of the user. Further advantages of the present invention are that the adjustable armrest is reliable and robust. Still other features of the adjustable armrest disclosed here is that it is simply constructed, relatively inexpensive, and easy to use.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof. For example, altering the shapes of the lower slide element, the upper slide element, the upper base or the armrest cover will still be considered equivalent structures and will also come within the literal language of the claims. The same is true of the fasteners, the springs and the washers. Still other alternatives will also be equivalent as will many new technologies. There is no desire or intention here to limit in any way the application of the doctrine of equivalents nor to limit or restrict the scope of the invention.

What is claimed is:

1. An adjustable armrest assembly for a chair comprising:

a mounting member connected to the chair, the mounting member having an upper base;

a first horizontal slide element slidably mounted to the upper base, the first slide element being adjustably slidable in a horizontal first direction with respect to the upper base, and the first slide element being restrained after adjustment with respect to the upper base by frictional engagement between the upper base and the first slide element, the first slide element including an upper surface having first and second guide rails extending in a horizontal first arcuate path that crosses the first direction; and a second horizontal slide element for slidably mounting to the first slide element that is rotatable in a horizontal arcuate path that crosses the first direction and has a vertical axis of rotation that does not pass through the adjustable armrest assembly, the second slide element including a lower surface having first and second arcuate recesses for engaging the first and second guide rails of the upper surface of the first slide element, the second slide element restrained after adjustment with respect to the first slide element by frictional engagement between the second slide element and the first slide element.

2. The adjustable armrest assembly of claim 1, wherein the first slide element includes a slot formed therein directed along the first direction.

3. The adjustable armrest assembly of claim 2, wherein the upper base includes a fastener receiving opening therein, and wherein the adjustable armrest assembly further comprises:

a fastener received in the slot of the first slide element and in the fastener receiving opening of the upper base for adjustably mounting the first slide element to the upper base.

4. The adjustable armrest assembly of claim 3, and further comprising:

a guide for directing sliding movement of the first slide element with respect to the upper base.

5. The adjustable armrest assembly of claim 4, wherein the guide is mounted to the fastener and engages walls of the slot of the first slide element.

6. The adjustable armrest assembly of claim 5, wherein the fastener includes a stem and a head, and wherein the guide includes a washer through which the stem of the fastener extends, a side rim of the washer engaging the walls of the slot.

7. The adjustable armrest assembly of claim 6, and further comprising:

a biasing element disposed between the head of the fastener and the washer.

8. The adjustable armrest assembly of claim 1, wherein the second slide element includes at least one slot formed therein directed along the arcuate path.

9. The adjustable armrest assembly of claim 1, wherein the first slide element has first and second opposing longitudinal edges, wherein the second slide element includes a first and second opposing ends, and wherein when the second slide element is positioned in a terminal position along the arcuate path, the first end is more proximate one of the first and second edges than the second end.

10. An adjustable armrest assembly for a chair comprising:

a mounting member connected to the chair, the mounting member having an upper base;

a first horizontal slide element slidably mounted to the upper base, the first slide element being slidable in a horizontal first direction with respect to the upper base, the first slide element including an upper surface having first and second guide rails extending in a horizontal first arcuate path that crosses the first direction the first slide element maintaining after adjustment a substantially fixed position with respect to the upper base by frictional engagement; and a second slide element slidably mounted to the first slide element, the second slide element including a lower surface having first and second arcuate recesses for engaging the first and second guide rails of the upper surface of the first slide element such that the second slide element is rotatable in a horizontal arcuate path that crosses the first direction and has a vertical axis of rotation that does not pass through the adjustable armrest assembly.

11. The adjustable armrest assembly of claim 10, wherein the first slide element includes a slot formed therein directed along the first direction.

12. The adjustable armrest assembly of claim 11, wherein the upper base includes two fastener receiving openings therein, and wherein each of two fasteners are received in the slot of the first slide element and in one of the fastener receiving openings for adjustably mounting the first slide element to the upper base.

13. The adjustable armrest assembly of claim 12, and further comprising:

a guide for directing sliding movement of the first slide element with respect to the upper base.

14. The adjustable armrest assembly of claim 13, wherein the guide is mounted to the fastener and engages walls of the slot of the first slide element.

15. The adjustable armrest assembly of claim 14, wherein the fastener includes a stem and a head, and wherein the guide includes a washer through which the stem of the fastener extends, a side rim of washer engaging the walls of the slot.

16. The adjustable armrest assembly of claim 15, and further comprising:

a biasing element disposed between the head of the fastener and the washer.

17. The adjustable armrest assembly of claim 10, wherein the second slide element includes at least one slot formed therein directed along the arcuate path.

18. The adjustable armrest assembly of claim 10, wherein the first slide element has a first and second opposing longitudinal edges, wherein the second slide element includes a first and second opposing ends, and wherein when the second slide element is positioned in a terminal position along the arcuate path, the first end is more proximate one of the first and second edges than the second end.

19. An adjustable armrest assembly for a chair comprising:

a mounting member adapted to be connected to the chair, the mounting member having an upper base, the upper base including first and second guide rails extending in a horizontal first direction, and first and second spaced apart fastener receiving openings;

a first elongated slide structure mounted to the upper base and extending in the first direction, the first slide structure including a first elongated slot aligning with the first and second fastener receiving openings of the upper base and extending to a distance greater than the distance between the first and the second fastener receiving openings of the upper base, a lower surface for engaging the first and the second guide rails of the upper base, and an upper surface having first and second guide rails extending in a horizontal first arcuate path that crosses the first direction, and third and fourth spaced apart fastener receiving openings; and a second elongated slide structure mounted to the first slide structure and extending in the first direction, the second slide structure including second and third elongated slots, the second slot being aligned with the first fastener receiving opening of the upper surface of the first slide structure and the third slot being aligned with the second fastener receiving opening of the upper surface of the first slide structure, the second and third slots being substantially parallel to each other and extending in a horizontal second arcuate path that crosses the first direction and has a vertical axis of rotation that does not pass through the adjustable armrest assembly, and a lower surface having first and second elongated arcuate recesses for engaging the first and second guide rails of the upper surface of the first slide structure.

20. The adjustable armrest assembly of claim 19, and further comprising:

first and second fasteners positioned in the first slot of the first slide structure and in the first and second fastener receiving openings of the upper base.

21. The adjustable armrest assembly of claim 20, and further comprising:

first and second springs, the first spring being mounted around the first fastener and the second spring being mounted around the second fastener, the first and second springs to bias the first slide structure against the upper base.

22. The adjustable armrest assembly of claim 21, and further comprising:

third and fourth fasteners, the third fastener being positioned in the second slot of the second slide structure and in the third fastener receiving opening of the first slide structure and the fourth fastener being positioned in the third slot of the second slide structure and in the fourth fastener receiving opening of the first slide structure.

23. The adjustable armrest assembly of claim 22, and further comprising:

third and fourth springs, the third spring being mounted around the third fastener and the fourth spring being mounted around the fourth fastener, the third and fourth springs to bias the second slide structure against the first slide structure.

* * * * *